US008046963B2

(12) United States Patent
Wambaugh et al.

(10) Patent No.: US 8,046,963 B2
(45) Date of Patent: Nov. 1, 2011

(54) EXPANDABLE DRYWALL CORNER PIECE

(76) Inventors: Douglass Wambaugh, Bend, OR (US); Timothy Smythe, Bend, OR (US)

( * ) Notice: Subject to any disclaimer, the term of this patent is extended or adjusted under 35 U.S.C. 154(b) by 0 days.

(21) Appl. No.: 12/550,969

(22) Filed: Aug. 31, 2009

(65) Prior Publication Data

US 2010/0218444 A1 Sep. 2, 2010

Related U.S. Application Data

(63) Continuation of application No. 11/166,772, filed on Jun. 24, 2005, now abandoned.

(60) Provisional application No. 60/582,593, filed on Jun. 24, 2004.

(51) Int. Cl.
*E04B 2/00* (2006.01)

(52) U.S. Cl. ..... 52/287.1; 52/255

(58) Field of Classification Search ..... 52/255, 52/280, 287.1, 288.1, 417
See application file for complete search history.

(56) References Cited

U.S. PATENT DOCUMENTS

| | | | |
|---|---|---|---|
| 2,311,345 | A | 2/1943 | Mitchell |
| 3,942,295 | A | 3/1976 | Schacht |
| 3,955,677 | A | 5/1976 | Collingwood |
| 4,338,381 | A | 7/1982 | Rogers |
| 4,603,517 | A | 8/1986 | Lyons |
| 5,086,598 | A | 2/1992 | Weldy |
| 5,138,810 | A | 8/1992 | Kartler |
| 5,505,032 | A | 4/1996 | Wasserman et al. |
| 5,615,530 | A | 4/1997 | Kartler |
| 5,647,182 | A | 7/1997 | Rutherford |
| 5,699,638 | A | 12/1997 | Maylon |
| 6,002,087 | A | 12/1999 | Albert et al. |
| 6,119,420 | A | 9/2000 | Koenig et al. |
| 6,145,259 | A | 11/2000 | Koenig et al. |
| 6,502,358 | B2 | 1/2003 | Smythe, Jr. |
| D487,156 | S | 2/2004 | Hein et al. |
| D487,520 | S | 3/2004 | Hein et al. |
| D501,050 | S | 1/2005 | Hein et al. |

*Primary Examiner* — Robert Canfield
*Assistant Examiner* — Christine T Cajilig
(74) *Attorney, Agent, or Firm* — Clifford H. Kraft

(57) ABSTRACT

A drywall corner piece with flange surfaces forming a near right angle forming a cup for fitting over drywall corners where the web sections of the flanges have at least one strain relief channel allowing the piece to flex to different angles.

1 Claim, 4 Drawing Sheets

Fig 1B
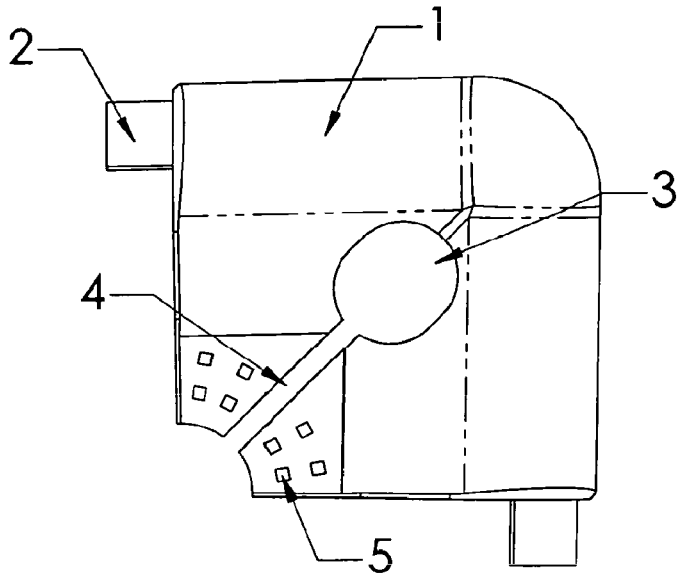
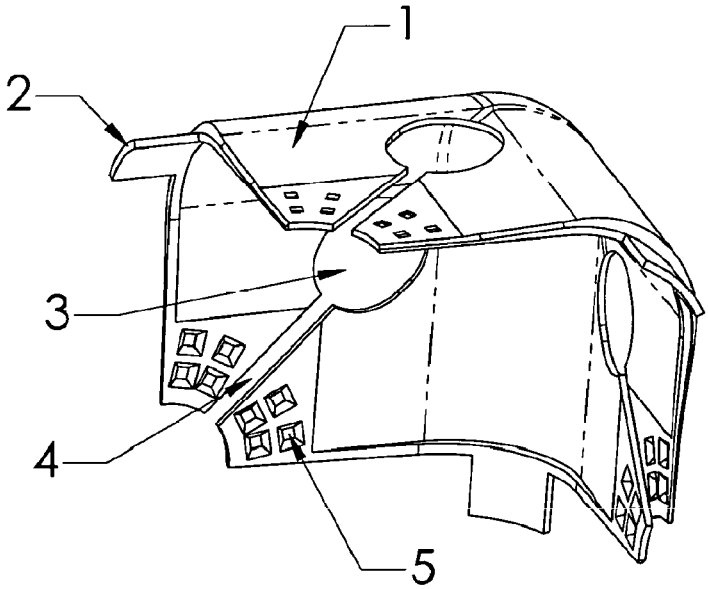
Fig 1A

Fig 2B
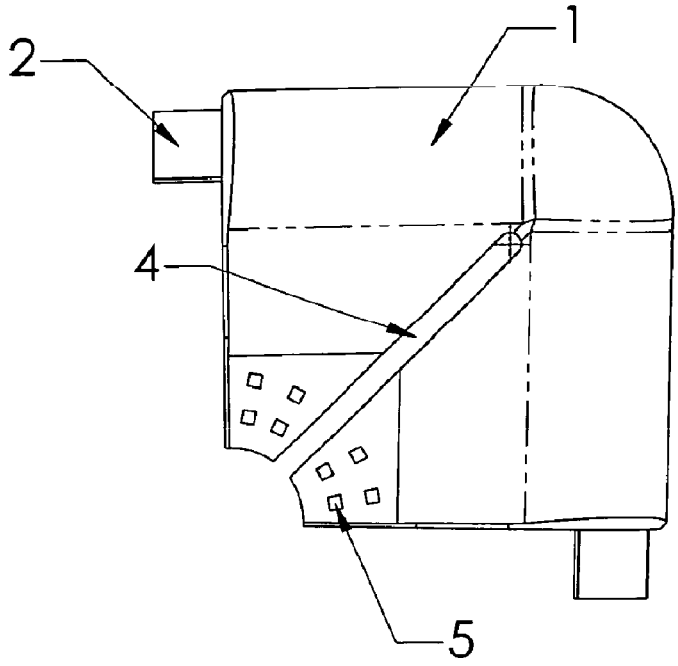
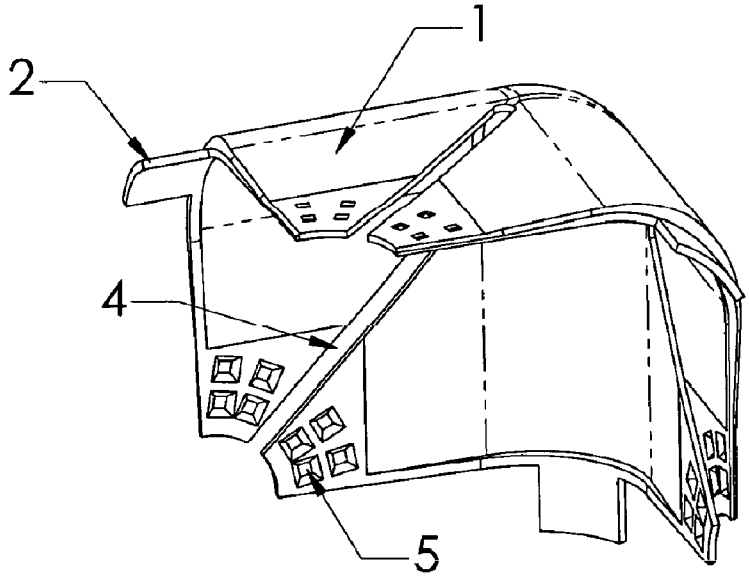
Fig 2A

Fig 3B
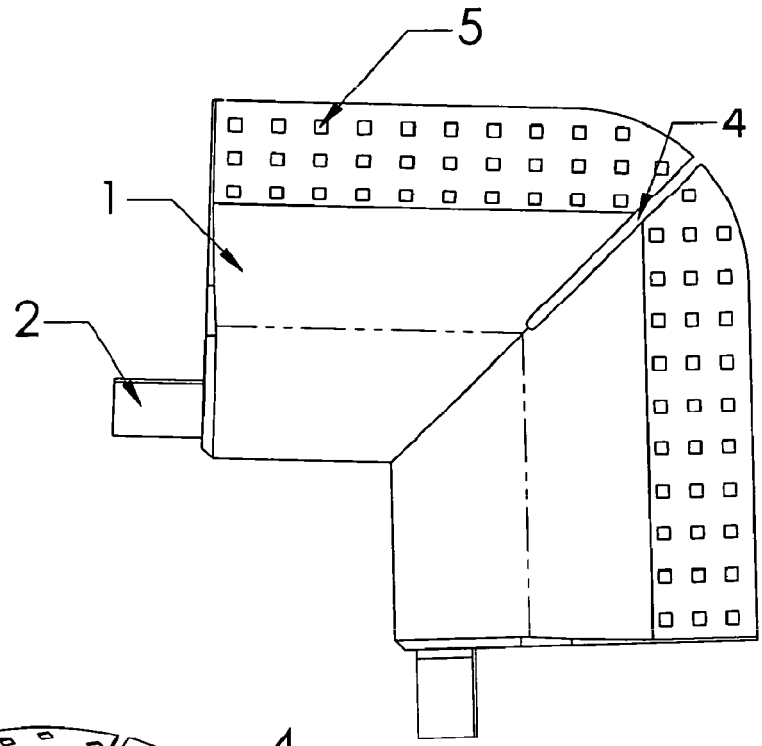
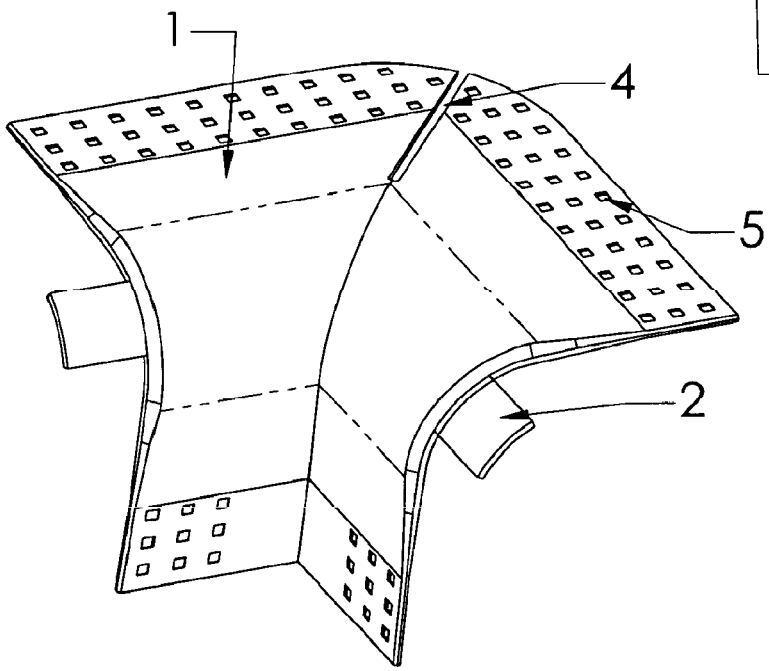
Fig 3A

Fig 4B
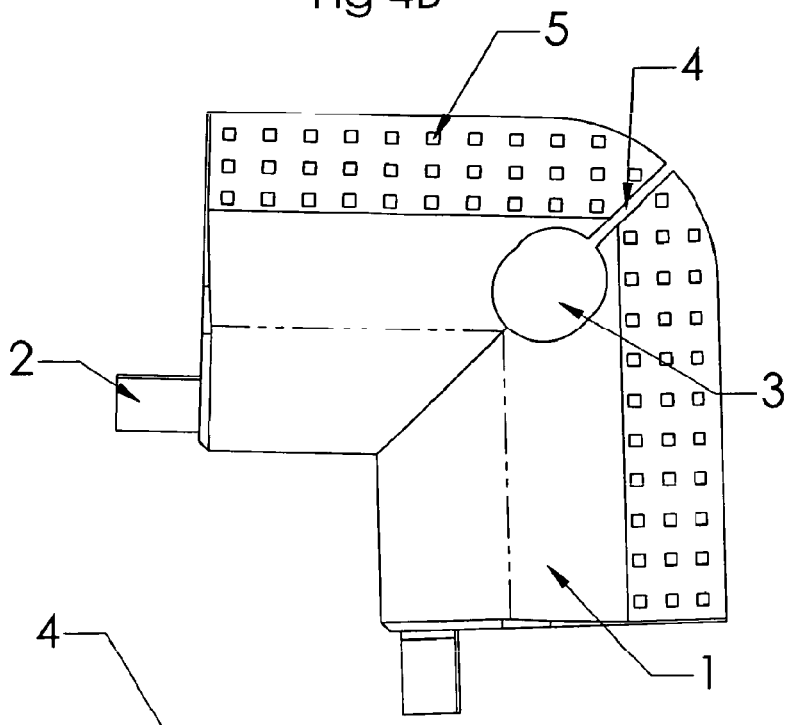
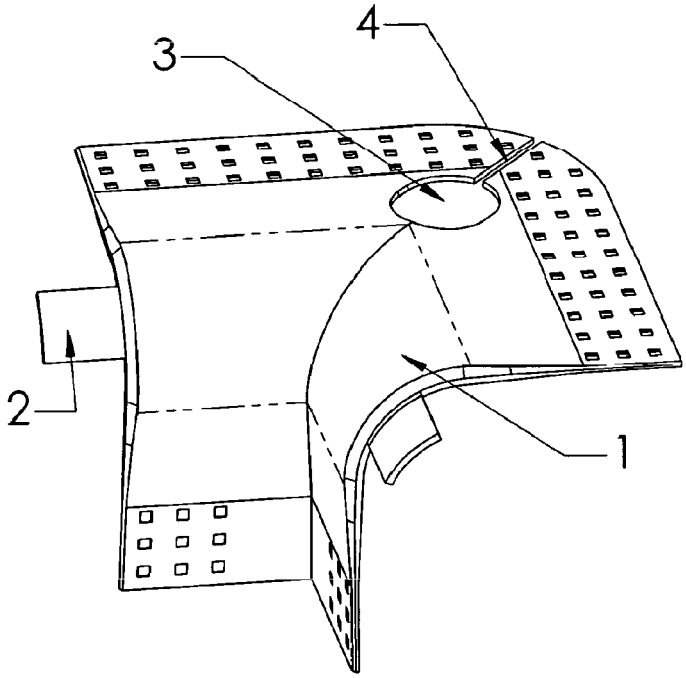
Fig 4A

EXPANDABLE DRYWALL CORNER PIECE

This is a continuation of application Ser. No. 11/166,772 filed Jun. 24, 2005, now abandoned. That application claimed priority from U.S. provisional patent application No. 60/582,593 filed Jun. 24, 2004. Application Ser. Nos. 11/166,772 and 60/582,593 are hereby incorporated by reference.

BACKGROUND

1. Field of the Invention

The present invention relates generally to the field of drywall trim and corners and more particularly to expandable drywall 3-way and 2-way outside and inside corner pieces.

2. Description of the Prior Art

Drywall corners are used to finish drywall seams both for interior and exterior use. A particular problem with finishing outside corners is the end termination. Prior art endcaps are closed and will not expand to fit arbitrary corners. A similar situation holds for interior corners.

What is badly needed is a drywall corner or cap that contains strain relief channels so that it can expand and snap fit over a drywall outside corner.

SUMMARY OF THE INVENTION

The present invention relates to a flexible drywall corner piece that includes flange surfaces forming a near right-angle corner cup for fitting over drywall corners where the flange surfaces are continuously connected by three web sections, and the web sections have a strain relief channel running from an outer edge into said web section so that the strain relief channel allows the flanges to flex to different angles.

DESCRIPTION OF THE FIGURES

FIGS. 1A and 1B show an outside 3-way corner with strain both a strain relief channel and hole.

FIGS. 2A and 2B show an outside 3-way corner similar to that of FIG. 1 but without a strain relief hole.

FIGS. 3A and 3B show an inside 2-way corner with strain relief.

FIGS. 4A and 4B show an inside 2-way corner with both a strain relief channel and hole.

Several drawings and illustrations have been presented in order to aid in the understanding of the present invention. The scope of the present invention is not limited to what is shown in the figures.

DESCRIPTION OF THE INVENTION

An embodiment of the present invention is shown in FIGS. 1A and 1B as an expandable 3-way outside corner. Three fairly symmetric flanges 1 are seen that are used to match the faces of the drywall end. The preferred total angle between the flanges is around 88 degrees; however, many other angles are within the scope of the present invention. Optional tabs 2 are seen on each of these flanges. These optional tabs 2 can be used to align drywall trim pieces into the corner. An expansion channel 4 opening into a relief area 3 can also be clearly seen. The preferred size of the channel is around 0.13 inch; however, any convenient size can be used. As the flanges 1 are fitted over the drywall corner, each flange can expand or contract along a separate expansion channel 4 and relief area 3 so that the drywall corner piece fits over the outside corner snugly. The piece can be made of any material with plastic being preferred. Optional holes 5 can be formed in the piece to allow better adhesion to drywall mud. The preferred size of the stain relief hole 3 is around 0.63 inches with many other sizes of hole being within the scope of the present invention.

FIGS. 2A and 2B show a part similar to that of FIGS. 1A and 1B but with now strain relief hole (ref. 4 in FIGS. 1A and 1B). All other features are almost identical. The part in these figures works because of the inherent flexibility of plastic material which is the preferred material for the part. More brittle material might crack causing a need for the hole; however, plastic, if not overstressed, will not.

FIGS. 3A and 3B show an interior expandable 2-way corner with similar features and that works in a similar way. In particular, the strain relief channel 4 allows the part to expand to snap or fit over an interior corner. For an interior corner, the preferred total angle is around 93 degrees; however, many other angles can be used. The preferred size of the strain relief channel 4 is around 0.06 inches with many other sizes possible.

FIGS. 4A and 4B show a similar part to that of FIGS. 3A and 3B, but with a strain relief hole 3. As stated before, a strain relief hole becomes more necessary with more brittle materials (or metal). This hole 3 in all the figures prevents any cracking or elongation of the channel when the part is under stress (for example when it is pushed into place). The preferred size of the strain relief hole 3 is around 0.6 inch with many other sizes being within the scope of the present invention.

The drywall corners of the present invention can be optionally prepared on its outer surface to directly receive paint or texture. The interior surface can likewise optionally contain a paper layer. While these optional layers are desirable for some uses, a basic plastic piece is the most common embodiment of the present invention because it can be used in any drywall situation.

The present invention has been described with the aid of certain text and illustrations. On skilled in the art will recognize that many changes and variations are possible. All of these changes and variations are within the scope of the present invention.

The invention claimed is:

1. A drywall end piece comprising:

a first flat flange positioned in a first plane, said first flange having a first center point and a first strain relief channel running diagonally from a first outer corner to a point near said first center point, said first flange also having an elongated first hole near said first center point;

a second flat flange positioned in a second plane, said second flange having a second center point and a second strain relief channel running diagonally from a second outer corner to a point near said second center point, said second flange also having an elongated second hole near said second center point;

a third flat flange positioned in a third plane, said third flange having a third center point and a third strain relief channel running diagonally from a third outer corner to a point near said third center point, said third flange also having an elongated third hole near said third center point;

wherein said first plane, said second plane and said third plane are nearly perpendicular;

a first arcuate section continuously connecting said first flat flange to said second flat flange;

a second arcuate section continuously connecting said second flat flange to said third flat flange;

a third arcuate section continuously connecting said third flat flange to said first flat flange;

arcuate tabs on said first, second and third arcuate sections;

a plurality of holes smaller than said first, second or third holes located near said first, second and third outer corners respectively.

* * * * *